United States Patent [19]

Hightower et al.

[11] 4,084,992

[45] Apr. 18, 1978

[54] SOLID PROPELLANT WITH ALUMINA BURNING RATE CATALYST

[75] Inventors: James O. Hightower; James W. Hamner; Richard L. Matthews, all of Huntsville, Ala.

[73] Assignee: Thiokol Corporation, Newtown, Pa.

[21] Appl. No.: 679,101

[22] Filed: Apr. 22, 1976

[51] Int. Cl.[2] ..... C06B 45/08

[52] U.S. Cl. ..... 149/17; 149/18; 149/19.1; 149/19.9; 149/21; 149/110

[58] Field of Search ..... 149/19.1, 19.9, 20, 149/21, 110, 17, 18

[56] References Cited

U.S. PATENT DOCUMENTS

| | | | |
|---|---|---|---|
| 3,310,946 | 3/1967 | Dobbins | 149/110 X |
| 3,822,154 | 7/1974 | Lawrence et al. | 149/19.1 |
| 3,924,405 | 12/1975 | Cohen et al. | 149/19.9 X |
| 3,986,906 | 10/1976 | Sayles | 149/19.9 X |

*Primary Examiner*—Edward A. Miller

*Attorney, Agent, or Firm*—Stanley A. Marcus; Royal E. Bright

[57] ABSTRACT

Finely divided aluminum oxide increases the burning rate, reduces the pressure exponent at high pressures and stabilizes the combustion of solid propellant compositions.

4 Claims, 8 Drawing Figures

SOLID PROPELLANT WITH ALUMINA BURNING RATE CATALYST

BACKGROUND OF THE INVENTION

The combustion of solid propellants is a progressive phenomenon localized on the surface of the propellant grain. The burning rate, assuming homogeneous ignition, is defined as the distance traveled per second by the flame front perpendicularly to the exposed surface of the grain.

The burning rate is dependent upon the pressure of the surrounding gas phase. The relationship may be expressed $r = K \times P^n$ wherein $r$ is the burning rate, $K$ is a proportionality constant, $P$ is the absolute pressure and $n$ is the pressure exponent. It is apparent that when $n$ is positive increase in pressure will lead to increased burn rate and that the greater $n$ is, the greater will be the increase in $r$ for a given rise in $P$.

A propellant with a high burning rate expells a larger amount of gases in a given period of time than a slower burn rate propellant. The result is a higher mass flow rate to perform a desired function.

A catalyst is frequently used to transform a slower burning propellant into a faster burning one. A wide variety of catalytic materials are known to be useful for control of burning rate. Typical of these are materials such as iron oxide, ferrocene, copper oxide, copper chromite, various organometallic compounds, carborane and various carborane derivatives.

It is frequently advantageous to reduce the pressure exponent of a propellant so as to reduce the fluctuation in pressure caused by a change in burn rate induced, for example, by irregularity in manufacture of the propellant grain. A low pressure exponent normally is indicative of a low temperature sensitivity characteristic, and therefore has less effect on pressure with changes in temperature where the burning is conducted in a combustion chamber from which the combustion products are exhausted, as in a rocket.

While none of above mentioned burn rate catalyst are known to have the ability to also reduce the pressure exponent at high pressures (> 2000 psia), the catalyst of the instant invention possesses this property in both aluminized and non-aluminized solid composite propellants.

The tailoring of burning rate and physical properties in a propellant based on ammonium perchlorate but without metallic fuel such as aluminum powder is not difficult. When such propellants are tested in full scale rocket motors it is difficult to avoid combustion instability. The susceptibility of these propellants to such instabilities, commonly seen as oscillations in pressure thrust-time traces recorded during the combustion of a propellant, is most acute at high burning rates, and high test temperatures, although there are some exceptions.

Boosting propellant performance with powdered aluminum lends stability in that it dampens such oscillations. Such metal containing propellants burn with the evolution of copious amounts of smoke largely due to formation of metal oxides. Despite their inherent combustion instability metal free ammonium perchlorate propellants have the virtue of being relatively smokeless, except for HCl clouds.

Propulsion with low or zero smoke has become of increasing importance in a number of tactical weapons system. Excessive quantities of smoke produced by a propellant can interfere not only with weapons guidance, but in air launch operations, with pilot visibility in general. Smoke can also assist detection by the enemy in field operations.

The inclusion of catalytic amounts of finely divided aluminum oxide in metal free propellants containing inorganic perchlorate as the oxidizer permits the control of combustion instability while retaining the smokelessness of the combination.

SUMMARY OF THE INVENTION

The invention sought to be patented in its principal composition aspect resides in the concept of a solid propellant composition which comprises a binder component, an inorganic perchlorate component, and finely divided aluminum oxide.

The tangible embodiments of the principal composition aspect of the invention possess the inherent applied use characteristic of being gas producing compositions suitable for use in rocket propulsion and having enhanced burn rates, and stable burn characteristics.

The invention sought to be patented in a sub-generic composition aspect of the principal composition aspect of the invention resides in the concept of a solid propellant composition which comprises a binder component, an inorganic perchlorate oxidizer component and a finely divided aluminum oxide component having a surface area of from about 40 sq. meters per 100 grams of propellant to about 160 sq. meters per 100 grams of propellant.

The invention sought to be patented in a second subgeneric composition aspect of the principal composition aspect of the invention resides in the concept of a solid propellant composition comprising a binder component, an inorganic perchlorate oxidizer component, and a finely divided aluminum oxide component wherein said finely divided aluminum oxide is of a particle size sufficient to permit the incorporation of a surface area of said aluminum oxide of up to 80 sq. meters per 100 grams of said propellant composition by incorporating not more than 2% of said aluminum oxide in said propellant composition.

The invention sought to be patented in its principal process aspect resides in the concept of a process for increasing the burn rate and reducing the pressure exponent at pressures greater than 2000 psia of a solid propellant composition, in need thereof, comprising a binder component and an inorganic perchlorate oxidizer component, which comprises incorporating into said propellant during its formulation an effective amount of finely divided aluminum oxide.

DESCRIPTION OF THE PREFERRED EMBODIMENT

Figure 1:
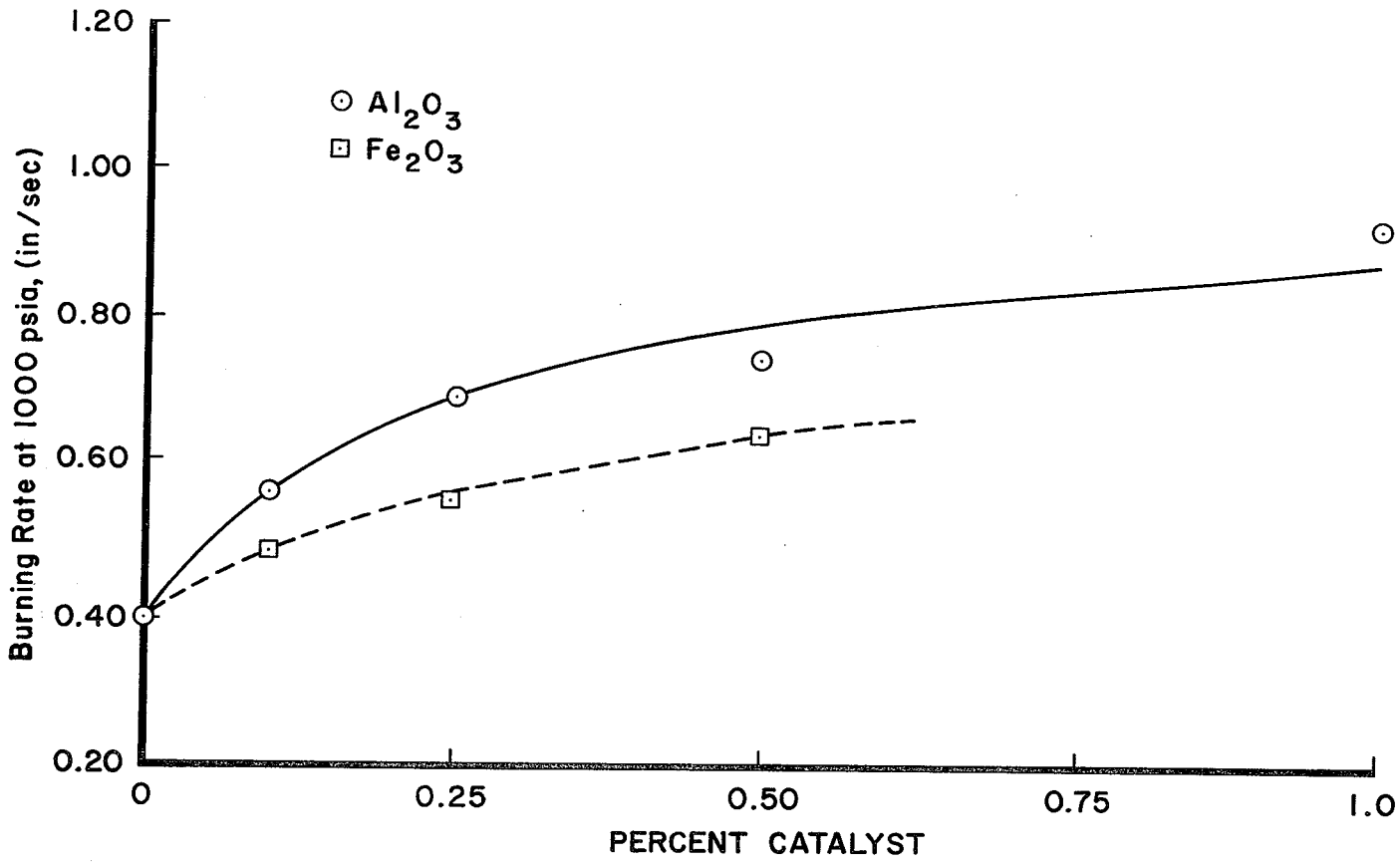
FIGS. 1–8 of the drawings are graphs showing burning rates, thrust profiles, and improvements resulting from the use of alumina according to the invention.

The propellant compositions may be prepared by methods well-known in the art. For example, the binder, plasticizer and burn rate catalyst may be blended in a mixer in the order listed, after which the inorganic oxidizer may be added in increments and mixing continued until uniformity is achieved. The curing agents, cross-linking agents or other additives generally may be added and thoroughly blended with the mix just prior to casting into a suitable mold or rocket motor. If desired, the last part of the mixing operation and the casting operation may be performed under vacuum to avoid air entrapment leading to voids in the propellant. Conveniently, when hydroxy terminated polybutadiene is the binder the temperature of the mix is maintained at about 140° F to 160° F so as to maintain a satisfactory viscosity during mixing and casting procedures. This temperature range of course, is not critical, any one skilled in the art would readily to able to adjust the temperature of any particular mix to attain a suitable viscosity.

The exact order of addition of the aluminum oxide burn rate catalyst is, of course, not especially critical. Pre-blending with the liquid binder is a preferred method because it is convenient and assures a complete dispersion of the aluminum oxide. The catalyst may also be added at the same time as the oxidizer or subsequent to the addition of the oxidizer.

Hydroxyl terminated polybutadiene based binders are convenient for use in these propellant systems. Illustrative of material suitable for this type of binder is the liquid resin R45M supplied by Arco Chemical Company. Other binder materials will also be suitable. Illustrative of these are, carboxy or epoxy terminated polybutadiene, copolymers such as polybutadiene acrylic acid, or polybutadiene acrylic acid acrylonitrile, asphalt and pitches including natural asphalt having a 170° F softening point, air blown asphalt having a 270° softening point, mixtures of asphalt and synthetic or natural rubber, pitch having a 240° F softening point, mixtures of pitch and rubber, epoxy resins such as Araldite 502 and Epon 834, other liquid polymers such as polybutene polyisobutylene, liquid polysulfide polymers, polyethylene, rubbers both natural and synthetic, such as butyl rubber, ethylacrylate methylvinylpyridine copolymers, waxes, both natural and synthetic, having a melting point within the range of 150° F to 300° F, synthetic resins and plastics, such as the various acrylic and polyvinyl resins, and nitro polymers such as polynitromethylmethylacrylate, nitropolybutadiene, and polynitrovinyl alcohols.

Where required, conventional curing agents are selected and employed to effect cure of the binder. For example, polyisocyanates are employed to cure hydroxy or epoxy terminated resins, and diaziridines, triaziridines, diepoxides, triepoxides and combinations thereof readily effect cures of carboxyl terminated resins. Normally an amount of curing agent up to about 2% by weight of all the combined propellant ingredients is sufficient for curing. The selection of the exact amount of curing agent for a particular propellant combination will be within the skill of one experienced in the art and will depend, of couse, upon the particular resin, the curing time, the curing temperature, and the final physical properties desired for the propellant.

The finished binder may include various compounding ingredients. Thus it will be understood herein and in the claims that unless otherwise specified, or required by the general context, that the term "binder" is employed generically and encompasses binders containing various compounding ingredients. Among the ingreidents which may be added is for example, a plasticizer such as dioctyl adipate, so as to improve the castability of the uncured propellant and its rheological properties after cure. The binder content of the propellant composition will usually range from about 8½ to 24% by weight.

The amount of aluminum oxide incorporated into a particular propellant composition will, or course, depend upon its particular surface area to weight ratio. In any particular composition the exact proportion will depend upon such factors as specific impulse, burn rate, pressure exponent and the degree of stabilization of combustion desired. Typically the aluminum oxide will be of such particle size that between 0.5 grams and 2 grams will have a surface area of between 10 and 160 sq. meters and in metal-free propellant will be used in a concentration such that 40 to about 160 sq. meters of catalyst surface will be available in 100 grams of propellant. Ammonium perchlorate is preferred as the oxidizer, conveniently as a mixture of unground 200 micron size particles and ground 16 micron size particles. The oxidizer is usually a major component of the total propellant composition, normally being about 75 to about 90% by weight of the total.

The following examples further illustrate the best mode contemplated by the inventors for the practice of their invention.

EXAMPLE 1

Low Smoke Propellants

Propellant compositions based on hydroxyl terminated polybutadiene containing 88% ammonium perchlorate (65% 200 microns, 35% 16 micron particle size) and aluminum oxide of a particle size having $80m^2$ surface area per gram, or iron oxide of particle size having $8m^2$ surface area per gram in the proportions shown in FIG. 1, are prepared and cast into straws to prepare strands having uniform cross section. These strands were tested for burn rate at 1000 psi. FIG. 1 shows the relative burning rates of these various compositions measured in inches/second. As formulations using iron oxide tend to become unstable when the burn rate exceeds 0.6 inches per second even at ambient temperatures, no data beyond that point was gathered.

EXAMPLE 2

Propellant compositions having the formulations shown in Table I were prepared by standard techniques. The properties of the formulations thus prepared are set forth in Table I. All thermo chemical properties were measured under standard conditions, in a surrounding atmospheric pressure of 1000 pounds per square inch (1000 psi) and optimum expansion. All propellants in Table I are characterized by ease of processing, even at 89% solids, good mechanical properties, especially strain levels at low temperature, and stable combustion, even at temperatures up to 160° F.

The particular hydroxyl terminated polybutadiene chosen for the binder has the structure:

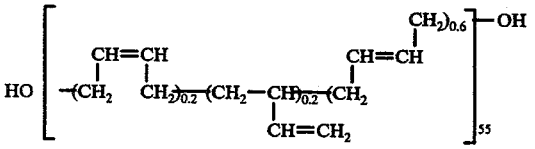

The antioxidant chosen to improve stability during formulation was 2,2'-methylene-bis-(4-methyl-6-tert-butyl)phenol.

The bonding agent was the bis-(2-methyl-aziridinyl)-derivative of isophthalic acid sold as HX-752 by Minn. Mining & Manufacture Co., and the curing agent was isophorone diisocyanate.

TABLE I

| Formulation | A | B | C | D |
|---|---|---|---|---|
| Ingredients | | Quantity (Wt. %) | | |
| Hydroxy terminated polybutadiene binder, antioxidant, curing agent | 11.2 | 9.7 | 8.7 | 8.7 |
| Dioctyladipate | 2.0 | 2.0 | 2.0 | 2.0 |
| Bis-(2-methyl-aziridinyl) derivative of isophthalic acid | 0.3 | 0.3 | 0.3 | 0.3 |
| $Al_2O_3$ ($80m^2$/gm) | 0.5 | 0.5 | 0.5 | 0.5 |
| Carbon Black | — | 0.5 | 0.5 | 0.5 |
| Ammonium Perchlorate | 86.0 | 87.0 | 88.0 | 88.0 |
| Total Solids (%) | 86.5 | 88.0 | 89.0 | 89.0 |
| Ammonium Perchlorate Blend Ratio | 70/30 | 70/30 | 65/35 | 52/29/19 |
| Ammonium Perchlorte Sizes (Microns) | 200/16 | 200/16 | 200/16 | 400/24/6 |
| EOM viscosity, kp at 140 20 F | 6 | 6 | 16 | 12 |
| Burn rate ($r_b$) at 1000 psia | 0.56 | 0.64 | 0.69 | 0.88 |
| Pressure Exponent (n) | 0.45 | 0.56 | 0.53 | 0.52 |
| Combustion Instability | No | No | No | No |
| PHYSICAL PROPERTIES 160° F | | | | |
| Max. Stress, psi | 312 | 444 | 507 | 476 |
| Strain at M.S., % | 114 | 134 | 107 | 86 |
| 70° F | 63 | 40 | 28 | 22 |
| Modulus, psi | 600 | 670 | 646 | 889 |
| Max. Stress, psi | 142 | 181 | 139 | 130 |
| Strain at M.S., % | 61 | 46 | 32 | 22 |
| −65° F | | | | |
| Modulus, psi | 16696 | 15099 | 18019 | 20879 |
| Max. Stress, psi | 837 | 1137 | 919 | 699 |
| Strain at M.S., % | 35 | 35 | 29 | 7 |

EXAMPLE 3

Figure 2:
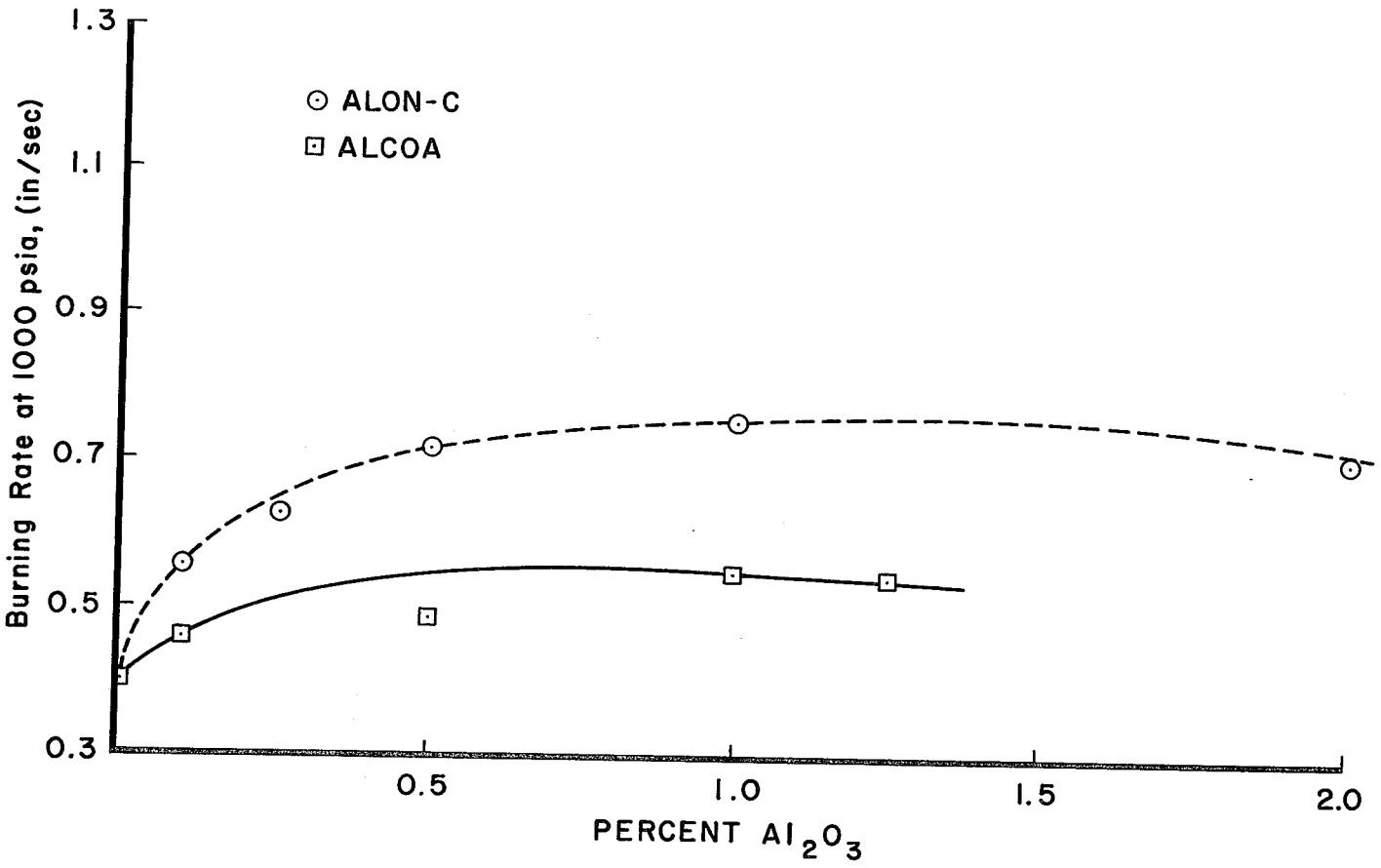

Propellant formulations were prepared from hydroxyl terminated polybutadiene polymer utilizing 88% ammonium perchlorate having a 200 micron to 16 micron size ratio of 65 to 35. Aluminum oxide catalyst of particle size having $80m^2$ per gram (Alon-C and $Al_2O_3$-—C) or $6.4m^2$ per gram (Alcoa) surface area were incorporated in the proportions shown in FIG. 2. The propellants were cast into straws and burned as in Example 1. The burning rates of the propellants containing the various catalyst sizes and concentrations are charted in FIG. 2.

Figure 3:
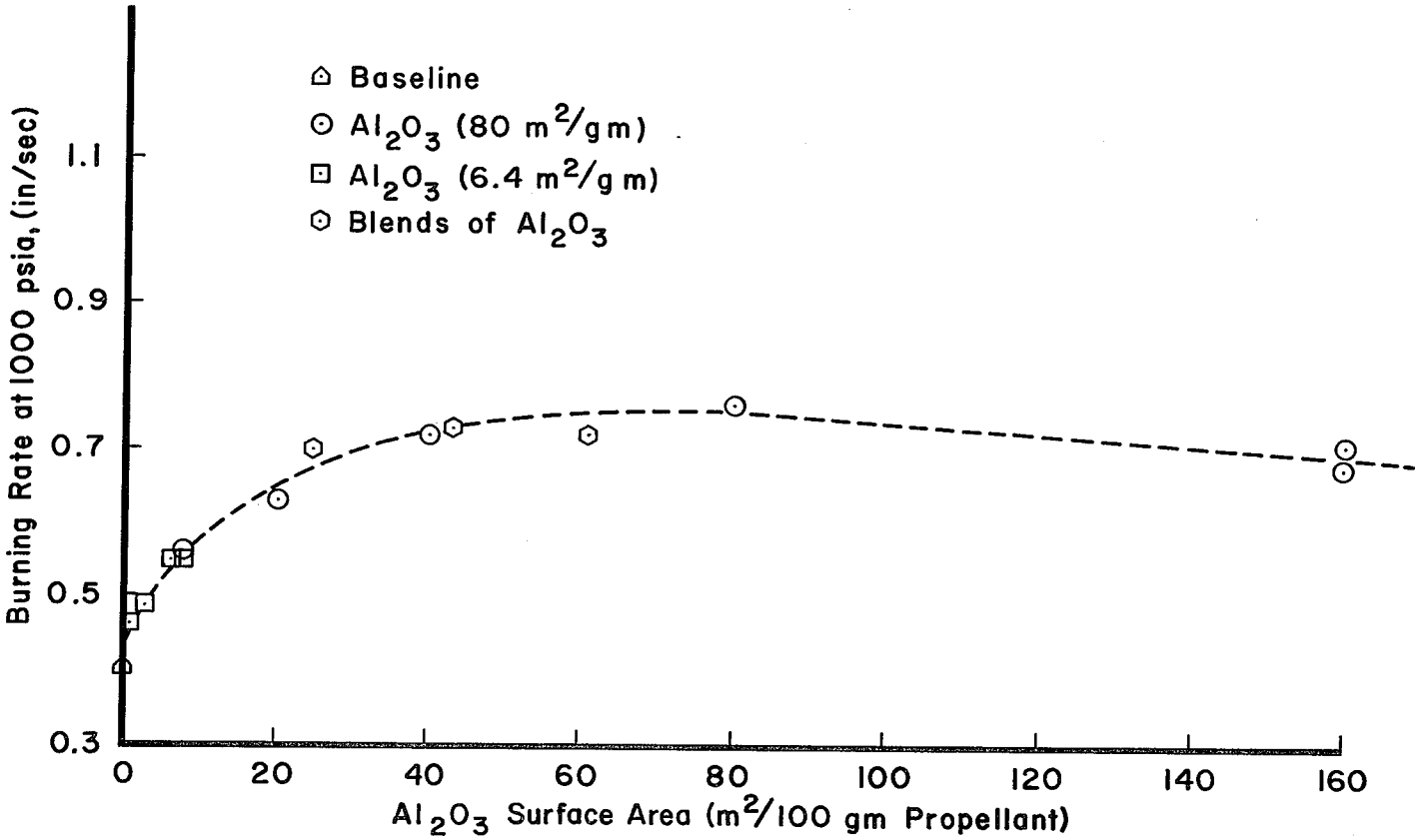

FIG. 3 illustrates the relationship between the relative surface area of the aluminum oxide incorporated in the above propellants.

EXAMPLE 4

Propellant compositions containing 1% aluminum oxide having a surface area of $80m^2$ per gram are prepared using hydroxy terminated polybutadiene binder and ammonium perchlorate (AP) at a constant ratio of AP to binder of 9.07.

Figure 4:
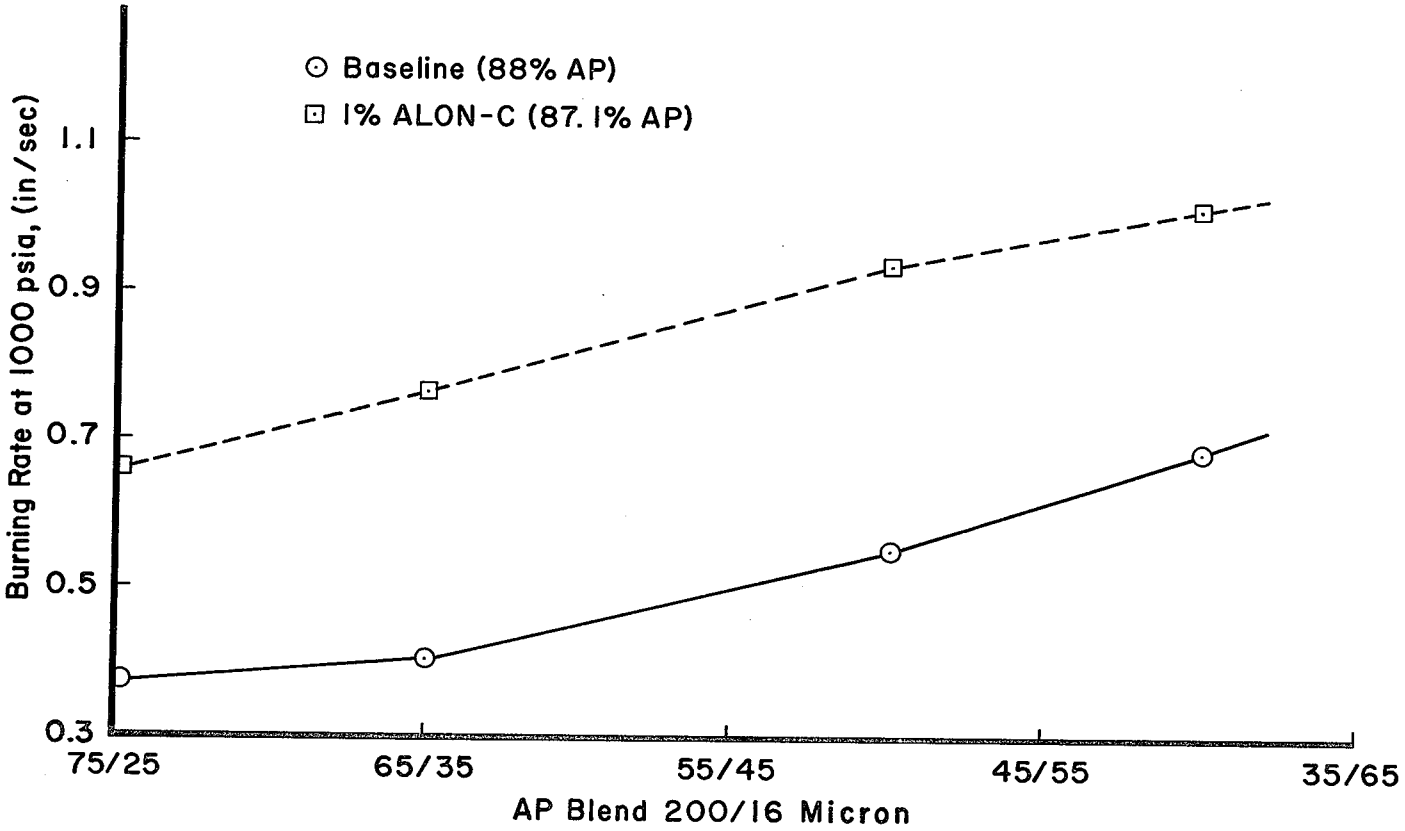

The ratio of 200 micron to 16 micron size AP was varied in the proportions shown in FIG. 4. FIG. 4 illustrates the effect on the burn rate of varying the proportion of AP sizes and the effect of the presence or absence of the aluminum oxide.

EXAMPLE 5

Propellant compositions analogous to those described in previous examples were formulated and cast into full scale demonstration test motors. The composition contained no catalyst (A), 1% ferric oxide as catalyst (B), ¼% $80m^2$ per gram aluminum oxide as catalyst (C), ¼% $80m^2$ per gram aluminum oxide as catalyst and ¼% carbon black (D). Each of the four motors was static tested at 170° F. The test was followed in standard fashion obtaining strain, thrust, pressure, acceleration, light attenuation measurements and the like, as well as high speed movies, and sequence camera pictures. During burning pressure pulse testing was applied to C and D during both boost and sustain operations as a means of aggravating possible instability had the potential for any existed.

Figure 5:
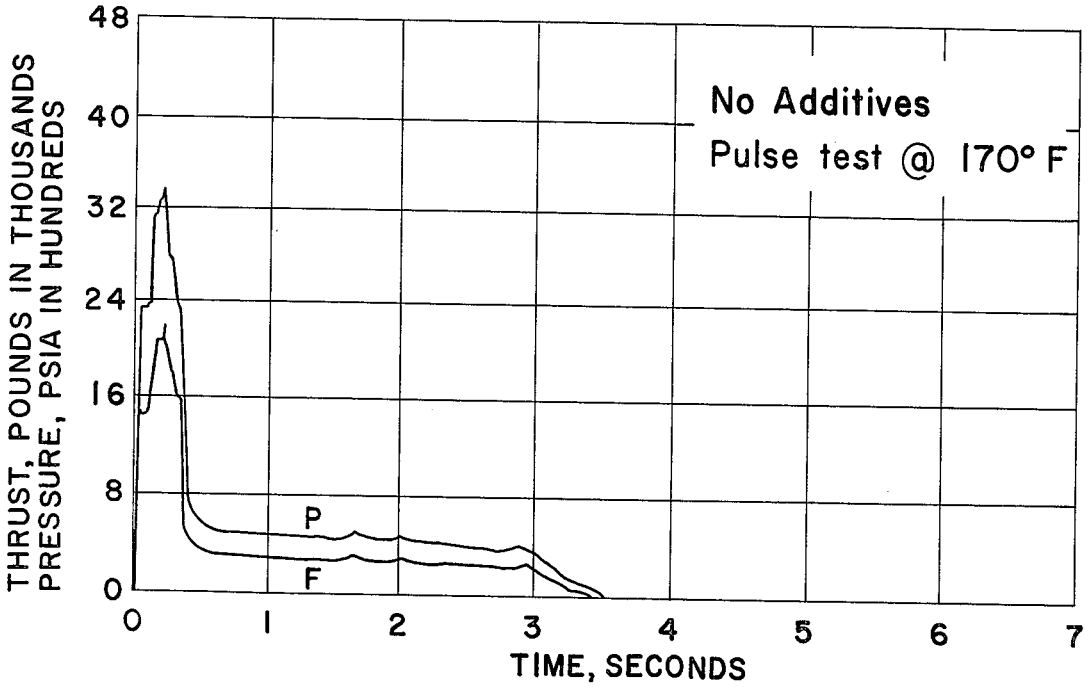
Figure 6:
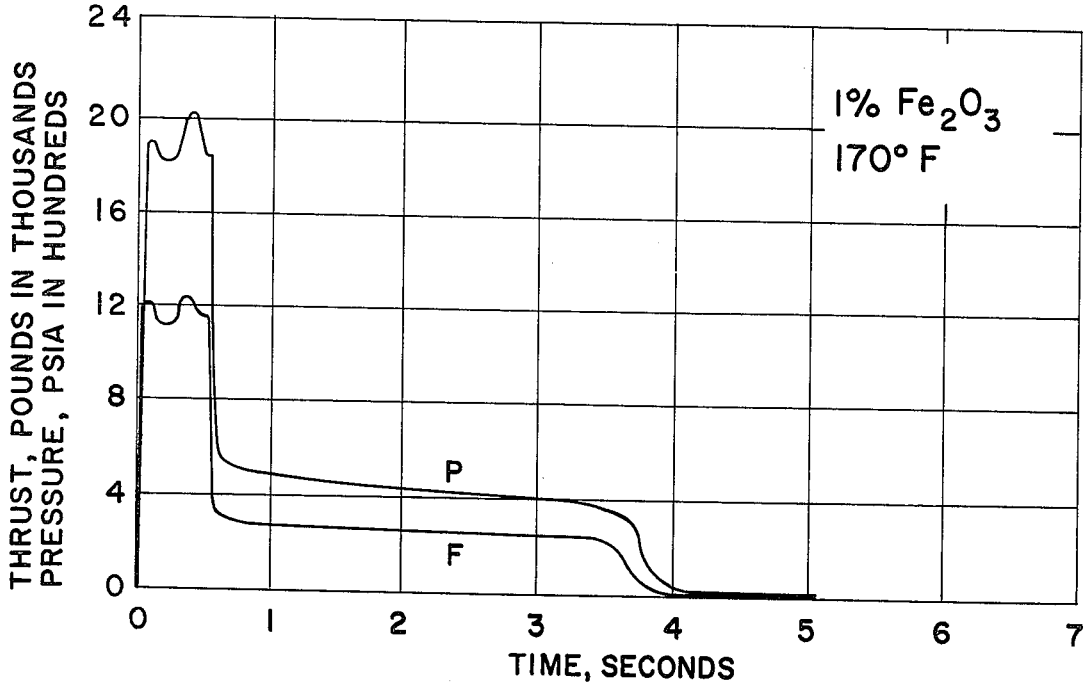
Figure 7:
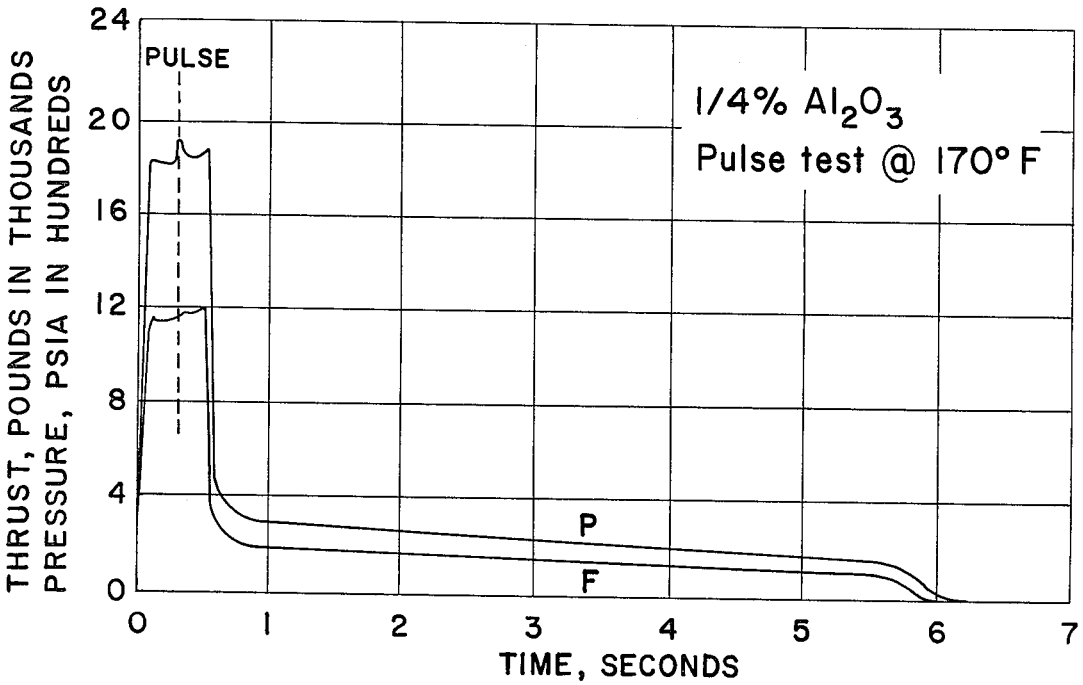
Figure 8:
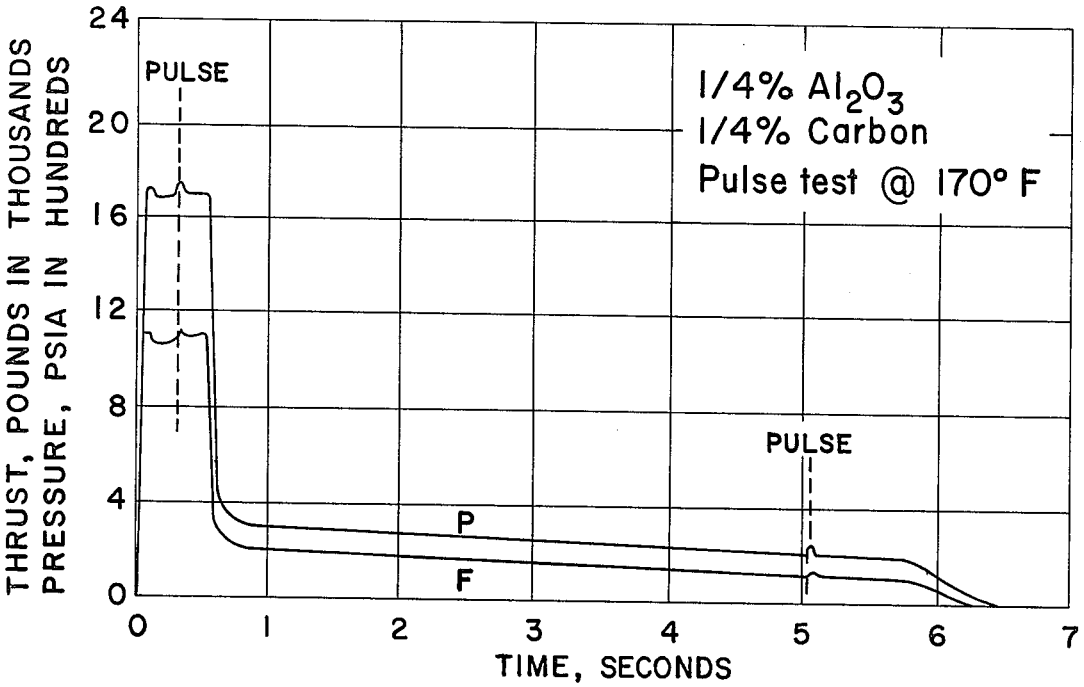

FIGS. 5 thru 8 are typical thrust vs time and pressure vs time measurements obtained. FIG. 5 is the pressure vs time and thurst vs time measurement for A. The combustion instability is apparent from the shape of the curve. FIG. 6 is the pressure vs time and thrust vs time measurement for B. In the boost phase combustion instability is apparent. FIG. 7 is the pressure vs time and thrust vs time measurement for C, and FIG. 8 in the pressure vs time and thrust vs time measurement for D. Stability in both the boost and sustain phases is evident.

EXAMPLE 6

Propellant compositions were prepared containing the ingredients and proportions shown in Table II.

TABLE II

| Formulation Ingredients | A | B | C |
|---|---|---|---|
| | Proportions (Wt. %) | | |
| Hydroxyl terminated polybutadiene based binder | 12.0 | 12.5 | 12.0 |
| Aluminum Powder | 18.0 | 18.0 | 18.0 |
| Ammonium Perchlorate | 69.0 | 69.0 | 69.0 |
| Aluminum Oxide ($80m^2$/gm Surface) | 1.0 | 0.5 | — |
| Ferric oxide | — | 1.0 | |

The propellants were cast into straws and burned in an oil bomb at atmospheric pressures from above 1000 psi to about 8000 psi maximum.

A had a pressure exponent of 0.54 and the burn rate on the average increased in constant proportion to the atmospheric pressure increase. B had a pressure exponent of 0.52 and similarly the burn rate increased in constant proportion to the atmospheric pressure increase. C at atmospheric pressures of from about 1000 to about 3000 psi had a pressure of 0.46 and the burn rate increased in constant proportion to that point. Above 3000 psi the pressure exponent rose to greater values, for example, between 3000 and about 6000 psi it was estimated at 0.64 and from about 6000 to 8000 psi it was estimated at 0.69. It is evident that at higher pressure the proportioned increase in the burn rate per pressure increment is greater than at lower pressures.

The subject matter which Applicants regard as their invention is particularly pointed out and claimed as follows:

1. A solid propellant composition which comprises as essential ingredients a binder component, a perchlorate oxidizer component, and from 0.5% to 2% of finely divided aluminum oxide, said aluminum oxide having a total surface area of from 40 to 160 square meters.

2. A solid propellant composition as defined in claim 1 wherein the aluminum oxide has a surface area of 80 square meters per gram.

3. A solid propellant composition as defined in claim 1 wherein the inorganic perchlorate is ammonium perchlorate.

4. A process for the preparation of a solid propellant composition having increased burning rate and a reduced pressure exponent, said propellant composition comprising as essential ingredients a binder component, and an inorganic perchlorate oxidizer component, which comprises:

a. adding to and mixing with said propellant composition, while said propellant composition is still in an uncured condition, from 0.5% to 2.0% finely divided aluminum oxide, said aluminum oxide having a surface area of from 40 to 160 square meters; and b. curing the aluminum oxide containing propellant mix of step a.

* * * * *

UNITED STATES PATENT OFFICE

CERTIFICATE OF CORRECTION

Patent No. 4084992 Dated April 18, 1978

Inventor(s) James O. Hightower, James W. Hamner, and Richard L. Matthews

It is certified that error appears in the above-identified patent and that said Letters Patent are hereby corrected as shown below:

Column 5, Table I, column headed "Ingredients" at about line 14, delete "perchlorte" insert therefore--Perchlorate--; at about line 15, the expression "EOM viscosity, kp at 140 20F" should read --EOM viscosity, kp at 140°F; at about line 19 between "160°F" and "Maximum Stress, psi" and corresponding to the line of data beginning "312" insert --Modulus, psi--. Column 6, line 5 delete "thurst" insert therefore --thrust--; Table II about line 24, delete the value "1.0" for Ferric Oxide in the Formulation B column and insert the value --1.0-- for Ferric Oxide in the Formulation C column.

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*